US005640821A

United States Patent [19]

Koch

[11] Patent Number: 5,640,821

[45] Date of Patent: Jun. 24, 1997

[54] PLASTIC CONNECTOR PLUG FOR MODULAR FLOOR

[76] Inventor: Charles P. Koch, 8390 Crestdale Ct., Amberly Village, Ohio 45236

[21] Appl. No.: 539,443

[22] Filed: Oct. 5, 1995

[51] Int. Cl.[6] ..... E04B 5/00

[52] U.S. Cl. ..... 52/698; 52/263; 52/483.1; 52/582.1; 52/584.1; 52/630; 404/33; 404/40; 404/41

[58] Field of Search ..... 52/698, 630, 126.6, 52/177, 181, 263, 391, 483.1, 582.1, 582.2, 584.1, 585.1, 587.1; 404/34, 35, 39, 40, 41, 43, 44

[56] References Cited

U.S. PATENT DOCUMENTS

| | | | |
|---|---|---|---|
| 719,790 | 2/1903 | Gregory | 404/43 X |
| 841,998 | 1/1907 | Mulford | 52/584.1 |
| 3,295,272 | 1/1967 | Kanno | 52/126.6 |
| 3,775,918 | 12/1973 | Johnson | 404/43 X |
| 3,855,747 | 12/1974 | Langan | 404/34 X |
| 3,946,529 | 3/1976 | Chevaux | 52/390 |
| 4,155,200 | 5/1979 | Emanuel | 52/630 X |
| 4,642,946 | 2/1987 | Koch | 52/126.6 X |
| 4,745,715 | 5/1988 | Hardwicke et al. | 52/126.6 |
| 4,901,490 | 2/1990 | Zinniel et al. | 52/263 |
| 5,052,157 | 10/1991 | Ducroux et al. | 52/263 X |
| 5,074,085 | 12/1991 | Ueda | 52/126.6 |

*Primary Examiner*—Carl D. Friedman
*Assistant Examiner*—Laura A. Saladino
*Attorney, Agent, or Firm*—Wood, Herron & Evans, L.L.P.

[57] ABSTRACT

A modular platform floor system for advantageous use at trade shows and conventions includes a plurality of interconnectable floor modules, wherein each module includes a supporting rectangular frame and a panel supported thereon, the platform having cutout, notched corners defining openings between two or more adjacently located floor modules, and plastic plugs which seat within these openings to interconnect the adjacently located modular units via downwardly depending prongs which engage the supporting frames of the modular units. Carpet pieces are secured separately to the top surfaces of the panels and to the plugs, to provide an aesthetic and comfortable surface for the floor. The plug is integrally formed, preferably of injection molded thermoplastic, to provide a unitary one piece plug for interconnecting the adjacently located floor modules. Compared to multi-piece plugs for floors of this type, an integrally formed plastic plug represents lower manufacturing costs per unit, fewer manufacturing steps, lower shipping costs due to lighter weight, lower susceptibility to loosening of the prongs, and better adherence to carpet secured thereto.

10 Claims, 2 Drawing Sheets

PLASTIC CONNECTOR PLUG FOR MODULAR FLOOR

FIELD OF THE INVENTION

This invention relates to modular floors used to set up temporary displays as at trade shows and conventions. More particularly, this invention relates to an improved connector plug for interconnecting separate modules of such modular floors.

BACKGROUND OF THE INVENTION

Applicant's U.S. Pat. No. 4,642,946 discloses a modular platform floor system particularly suitable for setting up a temporary, elevated display floor at trade shows and conventions. Generally, the platform floor includes a plurality of modular units, with each unit having a panel supported in an elevated position by a frame. If desired, the modular units used along the periphery, where heavy pedestrian traffic is expected, are ramped to facilitate stepping onto and off of the elevated floor.

At each corner of the floor unit, the system uses a locking member, or locking plug, to interconnect the unit to adjacently located units. The locking members provide a flush upper surface with the surrounding upper surfaces of the surrounding units, and the locking members also include downwardly directed portions which co-act with the respective frames to hold the floor together. Typically, a section of carpet is secured to each modular unit and to each separate locking member along the top surfaces thereof. Applicant expressly incorporates by reference herein, in its entirety, the disclosure of its prior U.S. Pat. No. 4,642,946.

The floor system shown in this patent has proved to be tremendously successful because of its simplicity in design and construction and its aesthetic appearance when in use. Nevertheless, applicant set out to improve upon the construction of this floor system in an effort to reduce the overall cost of the floor, to further simplify its manufacture and to further reduce maintenance.

SUMMARY OF THE INVENTION

This invention achieves the above-stated objectives with an integrally formed, molded plug for interconnecting adjacently located units of an elevated modular floor. This inventive plug, preferably injection molded of plastic, includes a base section for interfitting within the panels of adjacently located units, as in a puzzle, and the plug also includes downwardly depended brackets, or prongs, which extend downwardly into engagement with the frames to interconnect the adjacently located units.

More specifically, the prongs comprise four separate isosceles triangles spaced equidistantly from the corners of the plug, and the right angled sides of the triangles define two intersecting diagonal cutout regions for receiving adjacently located frame members when the plug is fitted into place. The bottoms of the prongs also include angled guides to facilitate fitting the plug into place during installation.

Compared to the prior locking member, which comprised a base ply of wood of about 0.5 inch thickness, an aluminum plate secured thereto and four metal prongs welded to the aluminum plate, this new plug is integrally formed, and of homogenous composition, due to the use of a one step injection molding process. This single piece construction reduces per unit manufacturing costs due to the use a singled relatively low cost material and the use of a single manufacturing step.

Additionally, this inventive plug is lighter than the previous locking member. Therefore, it may be shipped at a lower cost and is more easily handled. These two factors are important considerations because of the nature of these modular floors. Trade shows and conventions require frequent setup and tear-down for shipping to a new location.

One piece construction of this plug also provides a maintenance advantage. With the older locking members, during shipping and handling over a period of time, the welded metal prongs were susceptible to loosening. Also, the sharp edges of the metal prongs represented a potential hazard to handlers, and possibly to adjacently located materials. The one piece construction of this plug completely eliminates the susceptibility of the prongs to loosening. Further, the plastic edges of the prongs are significantly less hazardous than the edges of the metal prongs of the older locking members.

Finally, this inventive plug has a roughened, or textured, top surface. Applicant has learned that carpet tends to adhere better to the top surface of this plastic plug, as compared to the wood surface of the previous locking member.

These and other features of the invention will be more readily understood in view of the following detailed description and the drawings.

DETAILED DESCRIPTION OF THE DRAWINGS

Figure 1:
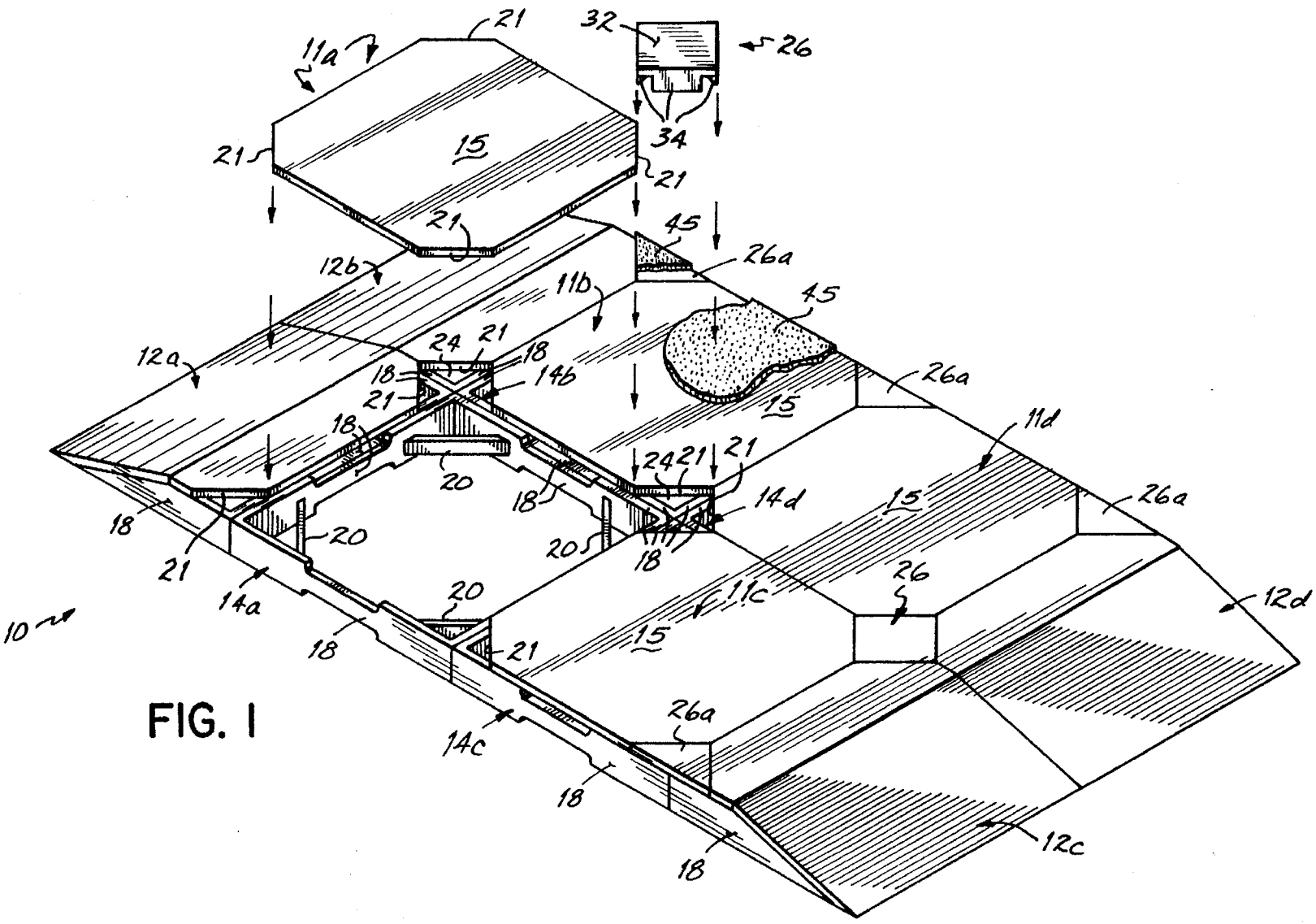
FIG. 1 is a perspective view of a modular floor system which includes the plug connectors of this invention.

FIG. 1 shows, in perspective, an exemplary modular floor system 10 in accordance with the invention. The system comprises four modular floor platform units designated 11*a, b, c,* and *d,* interconnected together as a 2×2 array. On two opposing lateral edges of the floor 10, ramp units 12*a* and 12*b* and 12*c* and 12*d* are connected to the platform units 11*c* and 11*b,* and 11*c* and 11*d,* respectively, to provide a gradually sloping border for the floor 10.

The ramp units are optional, and it will be appreciated that they may be used on some, all or no sides of the platform floor 10, depending upon the particular application. It will further be appreciated that the floor platform system 10 shown in FIG. 1 is smaller than would ordinarily be used. However, the principles of the invention remain the same, whatever the size or shape of the particular installation.

Each of the platform units 11 and the ramp units 12 is supported in an elevated position by an underlying frame 14. A typical frame 14 includes four side members 18, each with a relatively thin cut-out center portion, and four braces 20 located at the corners to provide structural support for the side member 18. Around the periphery, the frames 14 are adapted to accommodate the ramp units 12. That is, two of the side members 18 are angled to accommodate the ramp. If an edge of the floor system 10 is not ramped, a covering board may be located adjacent the outermost side members 18.

Each of the units 11 or 12 includes a corresponding panel 15. More specifically, FIG. 1 shows panel 15*a* disassembled from frame 14*a* by which 15*a* is supported. Although not shown in the drawing, the bottom surface of each panel 15 includes cleats secured thereto which engage the side members 18 of the respective frame 14, thereby to hold the panel 15 in place, so that the edges are contiguous with the edges of the respective frame 14. At the corners of the units 11 or 12, each respective panel 15 has a cut-out portion defined by an angled edge 21, so that the cut-out has the shape of a triangular corner notch. At positions where four units 11 or 12 meet, these edges 21 define a rectangularly shaped, preferably square, opening 24. This opening 24 resides directly above the engaged corners of the respective frames 14.

The plug 26 of this invention interfits downwardly into this opening 24, thereby to secure the corners of the frame 14 and to interconnect of the adjacently located units 11 or 12. Along the periphery of the floor system 10, the angled edges 21 of the panels 15 define openings 24*a* which are triangular in shape, rather than rectangular, and this shape requires a plug 26*a* which is corresponding in shape to fit into this triangularly shaped opening, thereby to interconnect only two adjacently located units 11 or 12. For these corner uses, the plug 26 of the invention may be cut in half, or preferably, simply molded as a separate piece for other peripheral uses. If desired, as disclosed in applicant's '946 patent, vertical display posts may be connected to the plugs 26, either temporarily or permanently, thereby to facilitate installation and tear-down of temporary, upright displays. Again, the general construction of this floor system 10 is identical to that disclosed in the '946 patent, and this invention relates solely to improvements to the plug 26.

Figure 2:
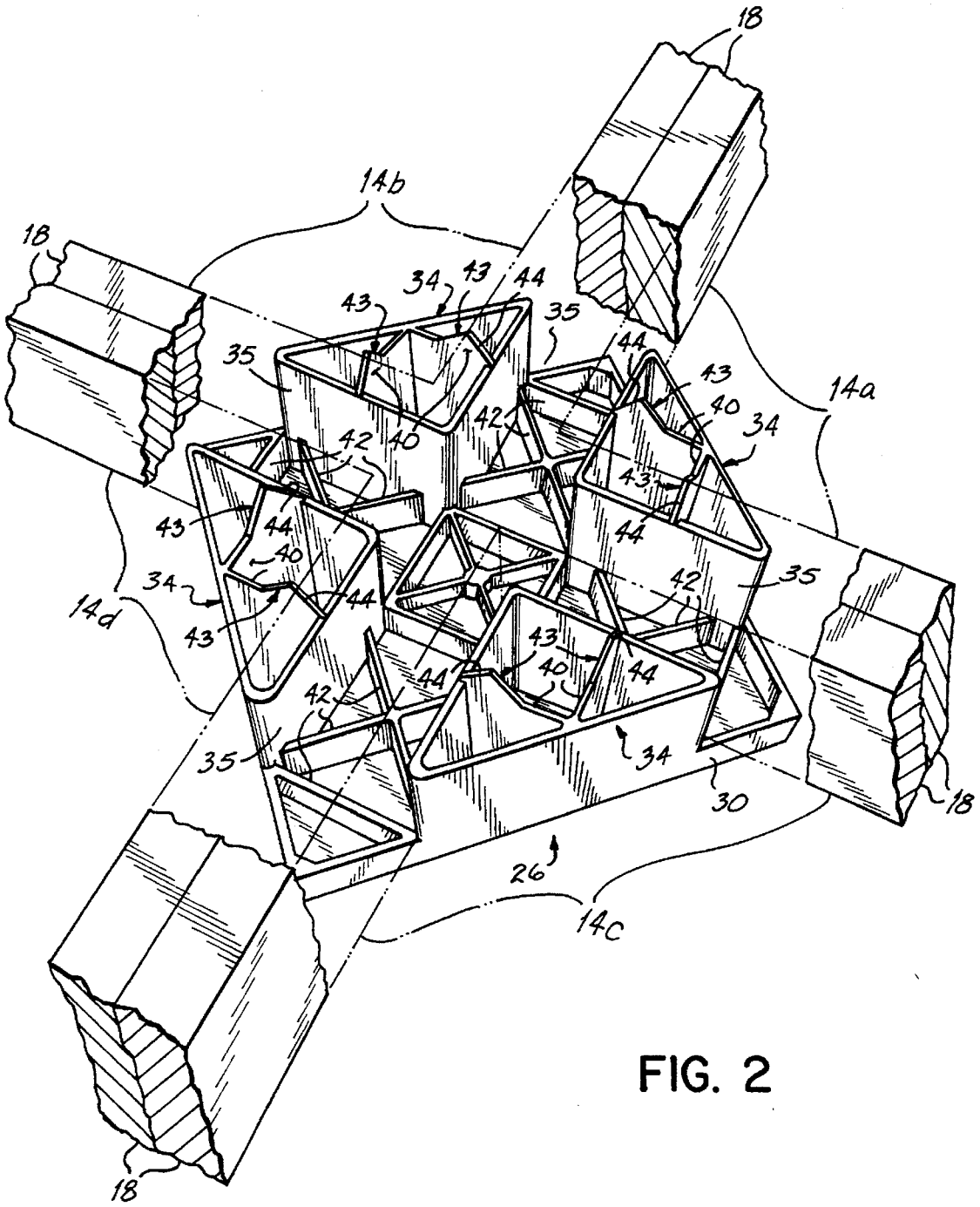
FIG. 2 is a perspective view of the bottom of a plug connector according to a preferred embodiment of the invention.

FIG. 2 shows an inverted perspective view of a preferred embodiment of the plug 26 of the invention, and more particularly to the full-shaped version of the plug 26 adapted for use at a position in the floor system 10 where four units 11 or 12 interconnect. More specifically, the plug 26 includes an upper base 30 bounded by an upper surface 32 (FIG. 1), and four identically shaped prongs 34 which depend downwardly from the base 30. Preferably, in cross-section each of these prongs 34 has a triangular shape in the form of a right angle isosceles triangle, and the prongs 34 are spaced equidistantly from the center of the plug 26 and from the corners of the plug 26.

This configuration defines two diagonally oriented cut-out paths 35 between the prongs 34. These cut-out paths or regions 35 represent the space occupied by the side members 18 of the supporting frames 14 for the adjacently located units 11. As shown more specifically in FIG. 2, side members 18, of frames 14*a*, 14*b*, 14*c* and 14*d* will extend between the prongs 34 to snugly occupy these cut-out regions 35, so that the corners of these frames 14 will be vertically aligned with the center point of the plug 26. Stated another way, the transverse dimension of each cut-out 35 is about twice the thickness of the side members 18.

The prongs 34 include internal walls 40 which provide added structural support. In addition to reinforcement, these internal walls 40 minimize the total volume of material needed to form the plug 26, resulting in reduced material costs and a lighter weight plug 26. The base 30 also includes internal reinforcing walls 42 which enhance the structural integrity of the plug 26. Preferably, the ends of the internal walls 40 include outer protrusions 43 with angled surfaces 44 directed toward the cutaway regions 35 of the plug 26. These angled surfaces 44 of the protrusions 43 help to steer or guide the plug 26 into center position with respect to a corner of four adjacently located floor units 11 or 12. For interconnecting adjacent units 11 and 12 along the periphery of the floor 18, the plug 26 is used in modified form. More specifically, only half the plug 26 is necessary, with the necessary plug shape being defined by a diagonal cut extending between any two corners of the plug 26 shown in FIG. 2. Preferably this "half plug" 26*a* is also formed by injection molding.

In use, the plugs 26 (and half plugs 26*a*) are installed and disconnected in the same manner as disclosed in the '946 patent. More specifically, they are fitted into the openings 24 (and 24*a*) when it is desired to use the floor 10, and then removed therefrom when the floor 10 is disassembled.

Plug 26 may be manufactured in any manner which produces sufficient structural rigidity, although applicant has found injection molding of thermoplastic material to be particularly advantageous for manufacturing the plugs 26 in a cost effective manner. Any suitable thermoplastic may be used, provided it is of sufficient structural rigidity to withstand the typical rigors of a floor used during convention and trade shows. If desired, the inside surface of the mold which forms the top surface 32 of the plug 26 may be treated to provide a roughened, or textured finish. Applicant has found this surface treatment to be advantageous in promoting adherence between the plug 26 and the carpet 45 secured thereto, as by adhesive. Since these plugs 26 are typically removed by grasping the carpet and pulling upwardly, it is important for the securement between the carpet and the top surface 32 to be relatively strong and long-lasting.

While this specification sets forth a preferred embodiment of the invention, applicant does not wish to be limited thereby. One of ordinarily skill in the art will readily appreciate that the invention contemplates variations and modifications of the plug 26 to suit specific situations.

I claim:

1. A connector for interconnecting the modules of a modular, elevated floor system, comprising:

a plug of one-piece construction adapted to secure at least two corners of two adjacently located floor modules, the plug including at least two downwardly depending prongs sized and shaped to co-act with said at least two corners to provide secure interconnection therebetween, the plug further being adapted to locate a top surface of the plug contiguous with top surfaces of the modules when connected therewith, each prong in horizontal cross-section having the shape of an isosceles right triangle.

2. The connector of claim 1 wherein the plug is formed of plastic.

3. The connector of claim 2 wherein the plastic plug is of homogenous material.

4. The connector of claim 1 wherein the plug has four downwardly depending prongs, each identical in shape to the others, the prongs being spaced equidistantly from the center of the plug and the corners of the plug.

5. The connector of claim 1 and further comprising internal supports located inside the prongs, thereby to enhance the structural support thereof and to minimize the weight of the plug.

6. The connector of claim 5 and further comprising:

angled guide surfaces depending from the internal supports, thereby to facilitate guiding the plug into position to interconnect the floor modules.

7. The connector of claim 1 wherein the top surface of the plug has a textured finish to facilitate adherence of carpet thereto.

8. A modular platform floor system comprising:

(a) a plurality of modular units arrayed side-by-side on a floor, in edgewise contact with one another, each unit comprising:

(1) an open centered rectangular peripheral frame having square corners, and (2) a planar rectangular panel separate from but supported by the frame, the panel seated on the edges of the frame so that the panels of said plurality form an uninterrupted surface, the panel having a triangular corner notch at at least two of its corners, the triangular notches exposing the respective square corners of the frame below; and (b) a plurality of plugs, each plug for securing adjacent frames together at their corners, the plug being rectangular in shape so as to fit into the open area defined by the adjacent corner notches on the respective panels, the plug having downwardly depending prongs which engage within the open centers of the frames at the adjacent square corners of the frames, thereby to hold the frames together, the plug being a one-piece construction of plastic, each prong in horizontal cross-section being triangular.

9. The modular platform floor system of claim 8 wherein the plug further comprises:

four downwardly depending prongs identical in size and shape.

10. The modular platform display system of claim 9 wherein in horizontal cross-section each prong has the shape of an isosceles right triangle, with the hypotenuse thereof located midway between two corners of the rectangularly shaped plug.

* * * * *